US008069883B2

(12) United States Patent
Shiraishi

(10) Patent No.: US 8,069,883 B2
(45) Date of Patent: Dec. 6, 2011

(54) BEVERAGE SUPPLY DEVICE

(75) Inventor: Naoyuki Shiraishi, Saitama (JP)

(73) Assignee: Sanyo Electric Co., Ltd., Moriguchi-Shi (JP)

( * ) Notice: Subject to any disclaimer, the term of this patent is extended or adjusted under 35 U.S.C. 154(b) by 868 days.

(21) Appl. No.: 11/727,700

(22) Filed: Mar. 28, 2007

(65) Prior Publication Data

US 2007/0227619 A1 Oct. 4, 2007

(30) Foreign Application Priority Data

Mar. 28, 2006 (JP) ..... 2006-087790

(51) Int. Cl.
*B65B 1/30* (2006.01)

(52) U.S. Cl. ..... 141/94; 141/360; 141/351

(58) Field of Classification Search ..... 141/94, 141/192, 198, 238, 285, 351, 360, 362
See application file for complete search history.

(56) References Cited

U.S. PATENT DOCUMENTS

| | | | | |
|---|---|---|---|---|
| 4,440,200 | A | 4/1984 | DeVale et al. | 141/95 |
| 5,312,017 | A | 5/1994 | Schroeder et al. | 222/23 |
| 2005/0029287 | A1 * | 2/2005 | Mobbs | 222/1 |
| 2006/0108023 | A1 * | 5/2006 | Greiwe et al. | 141/369 |

FOREIGN PATENT DOCUMENTS

| | | |
|---|---|---|
| EP | 1 489 042 A1 | 12/2004 |
| JP | 02-219790 | 9/1990 |
| JP | 03-216789 | 9/1991 |
| JP | 04-162197 | 6/1992 |
| JP | 10-222747 | 8/1998 |
| JP | 2000-335541 | 12/2000 |
| JP | 2001-270598 | 10/2001 |
| WO | WO 93/07085 | 4/1993 |

OTHER PUBLICATIONS

European Search Report dated Jul. 23, 2007.
Japanese Office Action dated Sep. 7, 2010 with English-language summary.
Japanese Office Action dated Nov. 24, 2010 along with its English Translation.

* cited by examiner

*Primary Examiner* — Gregory Huson
*Assistant Examiner* — Jason Niesz
(74) *Attorney, Agent, or Firm* — Kratz, Quintos & Hanson, LLP

(57) ABSTRACT

An object of the present invention is to provide a beverage supply device in which a setting operation for each beverage is simplified and in which supply of a wrong beverage can be avoided in advance. The beverage supply device executes a beverage supply operation of discharging a beverage material and a diluting liquid into a cup to mix the beverage material and the diluting liquid. The device includes: an information output section of a flavor card which retains inherent information such as a dilution ratio of a beverage; an information detecting section which reads out the inherent information of the beverage retained by this information output section; and a control unit which executes the beverage supply operation based on the inherent information read out by this information detecting section.

2 Claims, 3 Drawing Sheets

BEVERAGE SUPPLY DEVICE

BACKGROUND OF THE INVENTION

The present invention relates to a beverage supply device in which a beverage material and a diluting liquid are discharged into a cup, mixed and supplied.

Heretofore, in this type of beverage supply device, a system is adopted in which a syrup (a beverage material) stored in a storage vessel such as a tank and a diluting liquid such as water and/or carbonated water are discharged from a nozzle to a cup, mixed in the cup and supplied (see, e.g., Japanese Patent Application Laid-Open No. 2000-335541). Flavor cards on which names, photographs or illustrations of beverages to be supplied are described are attached to a front surface of the beverage supply device, and a customer selects the beverage with reference to the flavor cards.

In addition, inherent information such as a dilution ratio of the syrup and a gas (carbon dioxide) volume of the carbonated water for each beverage and a discharge time of the syrup and the diluting liquid for each cup size has heretofore been set (manually input) using a keyboard during installing of the beverage supply device and during changing of the beverage (flavor). Therefore, in a case where a large number of types of beverages are supplied, much time has to be consumed for the setting. Moreover, wrong setting might be performed.

Moreover, several types of amounts of beverages to be supplied can usually be selected in accordance with cup sizes such as S, M and L. Heretofore, the cup size has been selected by pressing a selection button. However, since much trouble is required for an operation, much time is lost during busy times. Moreover, the beverage has accidentally overflowed owing to a wrong operation.

SUMMARY OF THE INVENTION

The present invention has been developed to solve such a conventional technical problem, and an object of the present invention is to provide a beverage supply device in which a setting operation for each beverage is simplified and in which supply of a wrong beverage can be avoided in advance.

A beverage supply device of a first invention executes a beverage supply operation of discharging a beverage material and a diluting liquid into a cup to mix the beverage material and the diluting liquid, and is characterized by comprising: information retaining means for retaining inherent information such as a dilution ratio of a beverage; and control means for reading out the inherent information of the beverage retained by this information retaining means to execute the beverage supply operation.

A beverage supply device of a second invention is characterized in that the above invention further comprises a flavor card which displays the beverage, the flavor card being configured to retain the inherent information of the beverage.

A beverage supply device of a third invention is characterized in that the first invention further comprises a flavor card which displays the beverage, the flavor card being configured to retain information for use in reading out the inherent information of the beverage.

A beverage supply device of a fourth invention is characterized in that the above inventions further comprise a sensor which detects a size of the cup, and the control means executes the beverage supply operation based on the cup size detected by this sensor.

A beverage supply device of a fifth invention is characterized in that the above invention, a vertical position of the sensor can be changed.

According to the first invention, the beverage supply device which executes the beverage supply operation of discharging the beverage material and the diluting liquid into the cup to mix the beverage material and the diluting liquid includes the information retaining means for retaining inherent information such as the dilution ratio of the beverage and the control means for reading out the inherent information of the beverage retained by this information retaining means to execute the beverage supply operation. Therefore, the dilution ratio of each beverage and the like do not have to be set by manual input. In consequence, an operation of setting these inherent information can remarkably be simplified. Moreover, a disadvantage that wrong setting is performed can be avoided in advance.

In this case, in a case where the flavor card which displays the beverage is configured to retain the inherent information of the beverage as in the second invention, the inherent information of the beverage is read out by a simple operation of only attaching the flavor card of the beverage to be supplied to perform the beverage supply operation. Therefore, especially in a case where a plurality of beverage supply devices are installed, an operability during changing of the beverage and the like is further improved. Since the inherent information does not have to be retained by the beverage supply device itself, a control program capacity can be reduced, and a program itself can be simplified.

Moreover, as in the third invention, the flavor card may be configured to retain the information for reading out the inherent information of the beverage. Even in this case, when the flavor card is simply attached, the control means reads out the beverage inherent information related to the flavor card from the information retaining means. Therefore, an operability in setting the inherent information can be improved.

Furthermore, in a case where the device includes the sensor which detects the cup size and the control means executes the beverage supply operation based on the cup size detected by this sensor as in the fourth invention, an operation of selecting the cup size is not necessary. Especially during busy times, the beverage can quickly be supplied, and it is possible to avoid in advance a disadvantage that a wrong amount of the beverage is supplied by a wrong operation.

In addition, the vertical position of the sensor can be changed as in the fifth invention. Therefore, when, for example, the control means recognizes the changed position of the sensor in executing the beverage supply operation, a container having a size different from that of a usually used cup can be handled without any trouble, and an appropriate amount of the beverage can be supplied.

DETAILED DESCRIPTION OF THE PREFERRED EMBODIMENT

Figure 1:
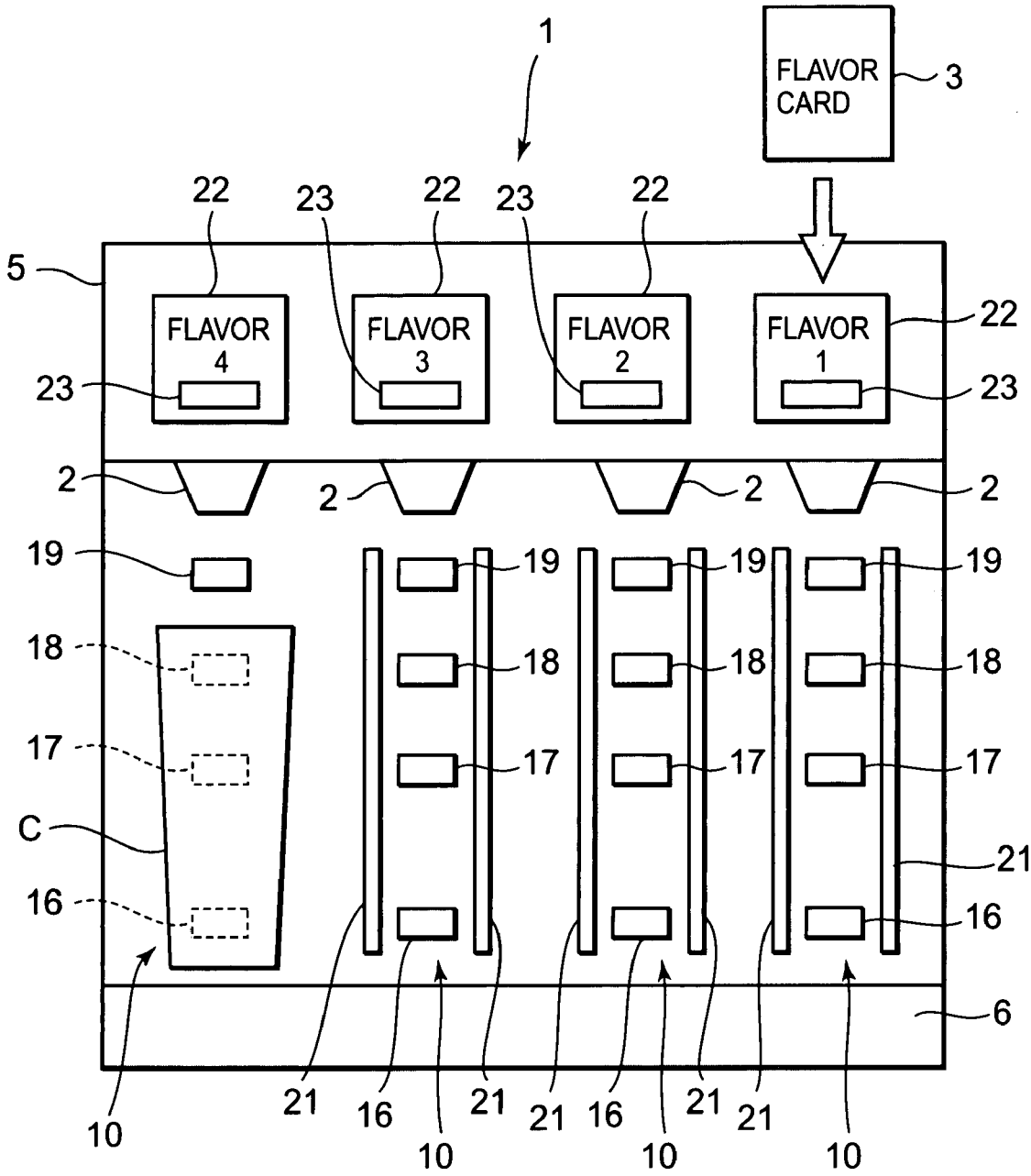
FIG. 1 is a front view of a beverage supply device according to an embodiment to which the present invention is applied.
Figure 2:
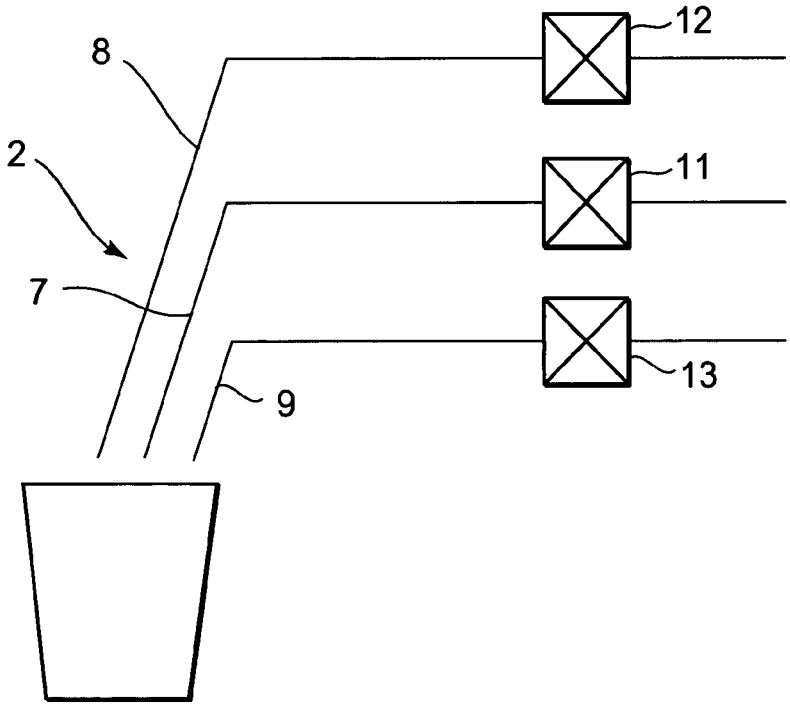
FIG. 2 is a pipe route diagram showing connection to a nozzle of the beverage supply device shown in FIG. 1.
Figure 3:
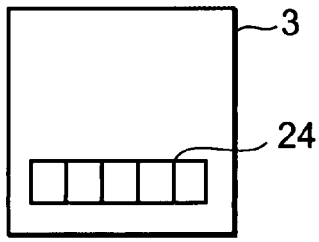
FIG. 3 is a front view of a flavor card to be attached to the beverage supply device of FIG. 1.
Figure 4:
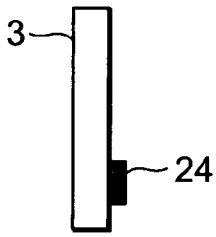
FIG. 4 is a side view of the flavor card of FIG. 3.

An embodiment of the present invention will hereinafter be described in detail with reference to the drawings.

A cooling tank and a carbonator (not shown) are stored in a main body 4 of a beverage supply device 1, and a cup receiving tray 6 protruding forwards is constituted in a lower part of a front surface of the device. This cup receiving tray 6 is provided with four cup size detecting sections 10 . . . in a horizontal direction, and nozzles 2 are arranged above the cup size detecting sections 10 . . . , respectively. The nozzles 2 . . . are arranged on a lower surface of a beverage display section 5 which protrudes in an upper part of the main body 4. Each of the nozzles 2 . . . includes a syrup pipe 7 (only one pipe is shown in each drawing, but actually the pipes corresponding to the number of types of syrups (four types in the embodiment) are arranged) which discharges the syrup as a beverage material; a water pipe 8 which discharges water as a diluting liquid; and a carbonated water pipe 9 which discharges carbonated water as another diluting liquid so as to face the cup. The pipes 7, 8 and 9 are connected to a syrup electromagnetic valve 11, a water electromagnetic valve 12 and a carbonated water electromagnetic valve 13, respectively.

The beverage supply device 1 is connected to a carbonic acid gas cylinder and a syrup tank (not shown), and the syrup is pushed from the syrup tank to the syrup pipe 7 by a gas pressure of the carbonic acid gas cylinder. The syrup pipe 7 is disposed so as to pass through the cooling tank, and the syrup pushed out is cooled while passing through the cooling tank, and discharged from the nozzle 2 at a time when the syrup electromagnetic valve 11 is opened. The above carbonator manufactures the carbonated water by use of water and a carbonic acid gas from the carbonic acid gas cylinder. The manufactured carbonated water is pushed out to the carbonated water pipe 9 disposed so as to pass through the cooling tank. The carbonated water is similarly cooled while passing through the cooling tank. Moreover, the carbonated water is discharged from the nozzle 2, when the carbonated water electromagnetic valve 13 is opened. The water pipe 8 is also disposed so as to pass through the cooling tank. The water is similarly cooled while passing through the cooling tank, and discharged from the nozzle 2 at a time when the water electromagnetic valve 12 is opened.

Moreover, in a beverage supply section under each of the nozzles 2 . . . , a cup presence sensor 16, an S-cup sensor 17, an M-cup sensor 18 and an L-cup sensor 19 are arranged from the bottom. Among these sensors, for example, the M-cup sensor 18 is disposed vertically movably along rails 21 positioned on opposite sides of the section in the front surface of the main body 4 (any rail is not shown at the leftmost beverage supply section as one faces the drawing, but the pipe is actually disposed).

On the other hand, in the beverage display section 5 positioned above the nozzles 2 . . . , attachment sections 22 of flavor cards 3 (four sections for flavors (beverages) 1 to 4) are arranged, respectively. The flavor card 3 is detachably attached to each of the attachment sections 22 . . . . Furthermore, each attachment section 22 is provided with an information detecting section 23 of the attached flavor card 3.

This flavor card 3 is a card to display the beverage to be supplied from the corresponding nozzle 2 disposed under the attachment section 22 to which the card is attached in a name, a photograph, an illustration and the like of the beverage. An information output portion 24.(information retaining means) constituting a part of the flavor card 3 is attached to a back surface of the card. In this information output portion 24, inherent information such as a dilution ratio of the syrup of the beverage, a gas volume (carbon dioxide) of the carbonated water and a discharge time of the syrup and the diluting liquid for each cup size is written by, for example, magnetism. Furthermore, when the flavor card 3 is attached to the attachment section 22, the inherent information written in this information output portion 24 is read out by the information detecting section 23.

It is to be noted that in addition to a system of writing the information by the magnetism, the information output portion 24 of the flavor card 3 may include an IC chip, a barcode and the like.

Figure 5:
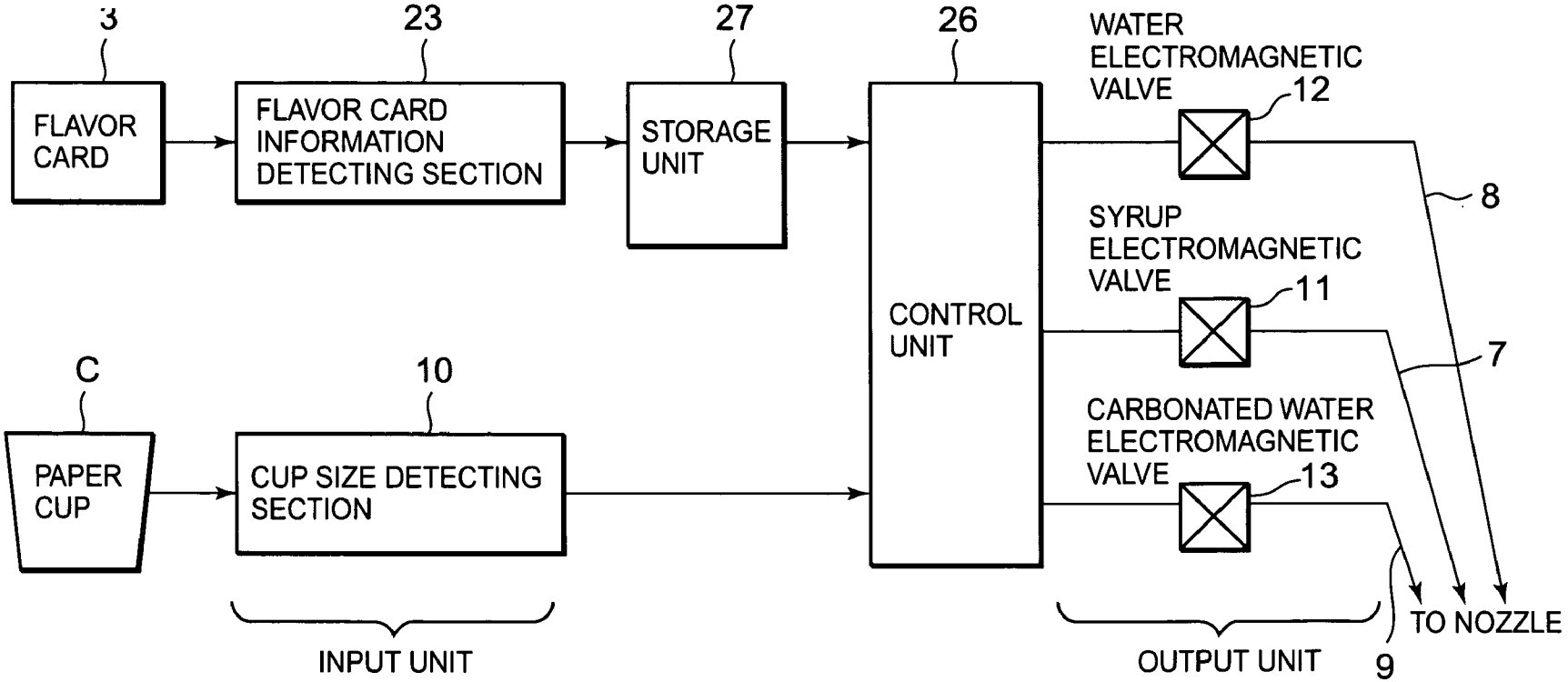
FIG. 5 is a block diagram of an electric circuit of the beverage supply device shown in FIG. 1.

Next, in FIG. 5, reference numeral 26 is a control unit constituted of a microcomputer, and 27 is a storage unit constituted of a memory. The control unit 26, the storage unit 27, the information detecting section 23, the cup size detecting section 10 (an input unit), the electromagnetic valves 11 to 13 (an output unit) and the like constitute control means of the beverage supply device 1. The control unit 26 controls the electromagnetic valves 11 to 13 to execute a beverage supply operation based on the inherent information read by the information detecting section 23 and outputs of the sensors 16 to 19 of the cup size detecting section 10.

Next, the beverage supply operation executed by the control unit 26 will be described. First, in an embodiment in which a power supply of the beverage supply device 1 is energized to supply the beverage, the flavor cards 3 . . . of four types of beverages at maximum are selected and attached to the attachment sections 22 . . . of the flavors 1 to 4. The information detecting sections 23 . . . of the attachment sections 22 read out the inherent information of the beverage written in the information output portions 24 of the attached flavor cards 3 to store the information in the storage unit 27. In this case, the inherent information (the dilution ratio of the syrup of the beverage, the gas volume of the carbonated water, the discharge time of the syrup and the diluting liquid for each cup size, etc.) on four types of beverages is stored.

In this case, assuming that the inherent information indicating a syrup name; melon, the dilution ratio; water syrup=4.0:1, the gas volume; no carbonic acid, and the discharge time of an M-size cup; 8.3 seconds (there are also discharge times for an S-size and an L-size) is written in the flavor card 3 attached to the left most attachment section 22 (the flavor 4) as one faces the drawing, the information detecting section 23 reads out this information, and writes the inherent information of the beverage of the flavor 4 (the leftmost side as one faces the drawing) in the storage unit 27.

Next, when a staff member or a customer mounts, for example, a cup C having an M-size on the cup size detecting section 10 disposed under the nozzle corresponding to the flavor 4 (the leftmost side as one faces the drawing), the cup presence sensor 16, the S-cup sensor 17 and the M-cup sensor 18 of the cup size detecting section 10 detect the cup C. Therefore, the control unit 26 judges that the cup C having the M-size has been put under the leftmost nozzle 2. Moreover, the information detecting section 23 reads out the inherent information of the beverage of the flavor 4 which is read from the information output portion 24 of the leftmost flavor card 3 (the flavor 4) and stored in the storage unit 27. Based on the inherent information, the syrup electromagnetic valve 11 and the water electromagnetic valve 12 of the syrup pipe 7 corresponding to a melon syrup tank are controlled (in this case, since any carbonic acid is not contained, the carbonated water electromagnetic valve 13 is closed), and the syrup and the water are discharged into the cup C from the nozzle 2 at the above dilution ratio for 8.3 seconds. The discharged syrup (melon) and the water are mixed in the cup C, and supplied as melon juice.

Since the inherent information of the beverage is retained by the flavor card 3 to display the beverage and read out by the information detecting section 23 to execute the beverage supply operation in this manner, the dilution ratio and the like of each beverage do not have to be set by the manual input. These setting operations of the inherent information can remarkably be simplified. It is also possible to avoid in advance a disadvantage that a wrong setting is made during installing of the beverage supply device 1 and changing of the beverage. Since the flavor cards 3 are used, an operability during the changing of the beverage or the like is further improved especially in a case where a plurality of beverage supply devices 1 are installed. In this case, the inherent information of all the beverages does not have to be retained in the storage unit 27 of the beverage supply device 1. Therefore, a storage capacity and a control program capacity can be reduced, and the program itself can be simplified.

In the above embodiment, the cup C of the M-size is used. However, the control unit 26 judges that the cup C has the S-size at a time when the cup presence sensor 16 and the S-cup sensor 17 detect the cup, and judges that the cup C has the L-size at a time when the S-cup sensor 17, the M-cup sensor 18 and the L-cup sensor 19 detect the cup. Moreover, the discharge time written in the storage unit 27 is read out based on this size judgment to discharge the syrup and the water from the nozzle 2.

Moreover, in the embodiment, the M-cup sensor 18 is disposed vertically movably along the rails 21, 21. For example, in a case where the beverage is supplied to a jug or the like having a height between a height of the M-size cup C and that of the L-size cup C, a vertical position of the M-cup sensor 18 is changed to an upper position in accordance with the height (the size) of this jug. The control unit 26 recognizes the height of this M-cup sensor 18 from a change of a electrostatic capacity of the rails 21, 21 or the like, and changes an amount (the discharge time) of the beverage to be supplied to the jug in accordance with a capacity of the jug.

In this manner, the vertical position of the M-cup sensor 18 can be changed. Moreover, the control unit 26 recognizes the changed position of the M-cup sensor 18 to execute the beverage supply operation. Therefore, the beverage can be supplied to any container such as the jug having the size different from that of the usually used cup C without any trouble, and an appropriate amount of the beverage can be supplied.

In this case, the changeable vertical position is not limited to the position of the M-cup sensor 18, and the vertical position of the S-cup sensor 17 or the L-cup sensor 19 may be changed. Alternatively, the vertical positions of all of the cup sensors 17 to 19 may be changed. In the above embodiment, the control unit 26 recognizes the changed position of the M-cup sensor 18 to change the discharge time of the syrup and the water, but the present invention is not limited to this embodiment. The inherent information of the only jug may be set to the control unit 26 by a keyboard or the like.

It is to be noted that in the above embodiment, the inherent information of the beverage is written beforehand in the information output portion 24 of the flavor card 3. However, the inherent information of each beverage is retained beforehand in the storage unit 27 (in this case, the storage unit 27 is the information retaining means), and only identification information for reading out the inherent information of the beverage may be written beforehand in the information output portion 24 of the flavor card 3. In this case, the storage capacity of the storage unit 27 cannot be reduced, but the setting operation itself can be simplified.

Furthermore, in the embodiment, the inherent information is set using the flavor card 3. However, the inherent information of each beverage may be written in the storage unit 27 beforehand, and the inherent information corresponding to each beverage to be supplied may be read out by an operation of a dip switch disposed on a control board or the like. Even in such a case, the setting operation can remarkably be simplified.

What is claimed is:

1. A beverage supply device which executes a beverage supply operation of discharging a beverage material and a diluting liquid into a cup to mix the beverage material and the diluting liquid, the device comprising:

at least one rail;

a flavor card which displays the beverage, the flavor card being configured to retain inherent information such as a dilution ratio of a beverage;

control means for reading out the inherent information of the beverage retained by the flavor card to execute the beverage supply operation; and a sensor which detects a size of the cup, said sensor being movable on said at least one rail, wherein the control means executes the beverage supply operation based on the cup size detected by the sensor.

2. A beverage supply device which executes a beverage supply operation of discharging a beverage material and a diluting liquid into a cup to mix the beverage material and the diluting liquid, the device comprising:

at least one rail;

information retaining means for retaining inherent information such as a dilution ratio of a beverage;

control means for reading out the inherent information of the beverage retained by the information retaining means to execute the beverage supply operation; and a sensor which detects a size of the cup, said sensor being movable on said at least one rail, wherein the control means executes the beverage supply operation based on the cup size detected by the sensor, further comprising:

a flavor card which displays the beverage, the flavor card being configured to retain information for use in reading out the inherent information of the beverage retained by the information retaining means.

* * * * *